US005921769A

United States Patent [19]

Lorek

[11] Patent Number: 5,921,769

[45] Date of Patent: Jul. 13, 1999

[54] CATALYTIC BURNER

[75] Inventor: Georges Lorek, St Nom la Breteche, France

[73] Assignee: Shell Research Limited, United Kingdom

[21] Appl. No.: 09/051,870

[22] PCT Filed: Oct. 23, 1996

[86] PCT No.: PCT/EP96/04656

§ 371 Date: Jul. 14, 1998

§ 102(e) Date: Jul. 14, 1998

[87] PCT Pub. No.: WO97/15785

PCT Pub. Date: May 1, 1997

[30] Foreign Application Priority Data

Oct. 24, 1995 [FR] France ..... 95 12507

[51] Int. Cl.[6] ..... F23D 14/12

[52] U.S. Cl. ..... 431/328; 126/91 R; 126/91 A

[58] Field of Search ..... 431/328; 126/91 R, 126/91 A

[56] References Cited

U.S. PATENT DOCUMENTS

| | | | |
|---|---|---|---|
| 3,801,212 | 4/1974 | Cutler | 431/328 |
| 4,189,294 | 2/1980 | Rice et al. | 431/7 |
| 4,375,949 | 3/1983 | Salooja | 431/328 |
| 4,927,353 | 5/1990 | Nomura et al. | 126/91 A |

FOREIGN PATENT DOCUMENTS

| | | | |
|---|---|---|---|
| 1401162 | 10/1969 | Germany . | |
| 1322972 | 7/1973 | United Kingdom | 431/328 |

*Primary Examiner*—Carroll B. Dority
*Attorney, Agent, or Firm*—Kim Muller

[57] ABSTRACT

The invention relates to a heating device (100) employing catalytic combustion of gas, especially of petroleum gases, comprising:

a flat combustion enclosure (110) delimited by two parallel large plane walls (111, 112), at least one of which is a heater plate made of a metallic material, the said combustion enclosure (110) being provided with at least one gas inlet **(130*a*, 132*a*, 132*b*, 134*a*) and one outlet (111*a*, 111*b*), a gas circulation circuit, devised inside the said combustion enclosure (110) between each gas inlet and each outlet, the gas circulation circuit passing through at least one catalytic contact surface (121*a*, 122*a*, 123*a*, 124*a*). According to the invention, the gas circulation circuit is defined by at least one catalytic support partition (121, 122, 123, 124)**, a longitudinal face of which constitutes the catalytic contact surface, the said partition extending perpendicularly to the heater plate, over practically the whole height of the said combustion enclosure so that the combustion front (121*b*, **122*b*, 123*b*, 124*b*)** situated on the said catalytic support partition is flush with the heater plate, in the manner of an electric resistor element in an electric heating device with heater plate.

20 Claims, 2 Drawing Sheets

CATALYTIC BURNER

Figure 1:
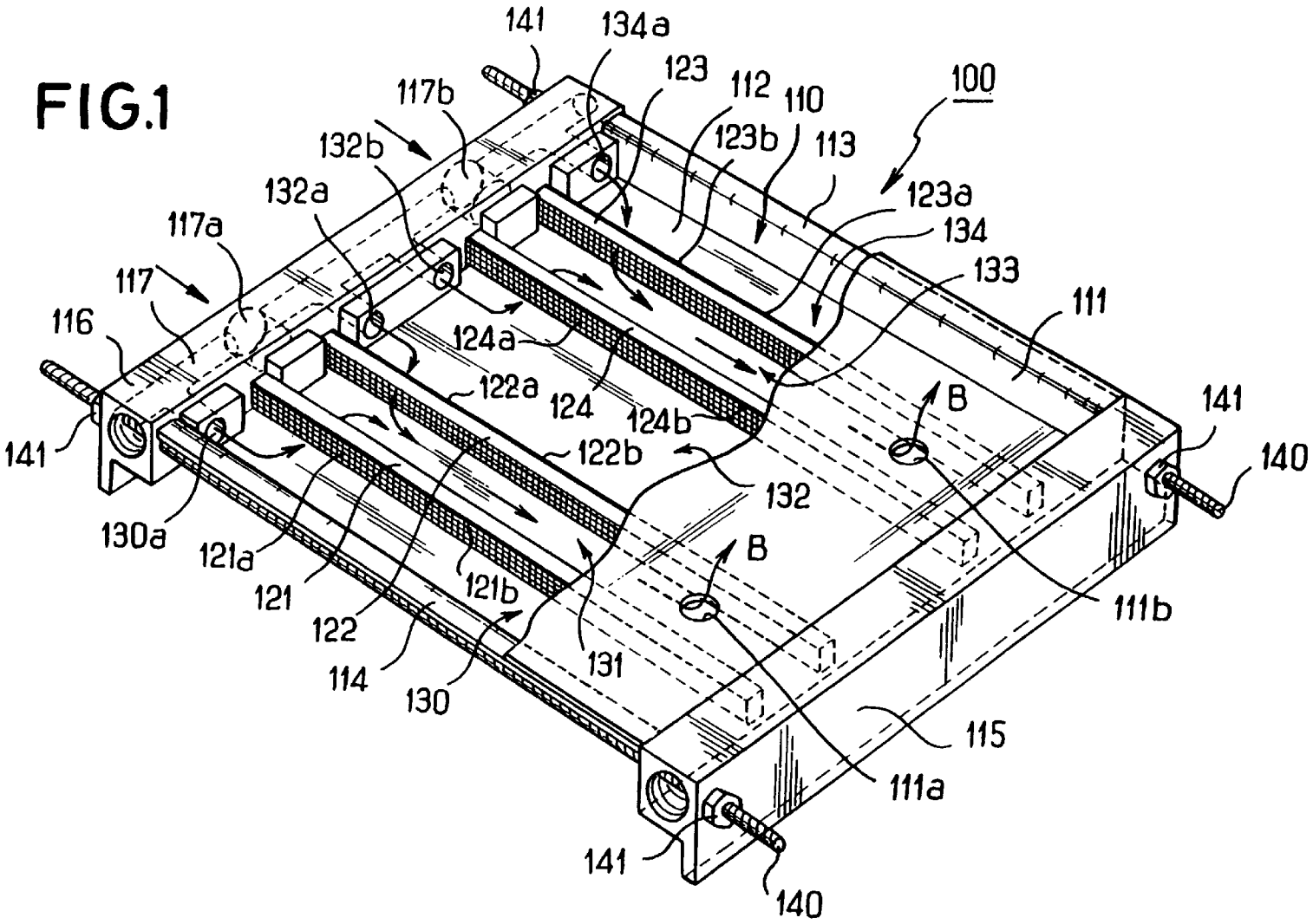

The present invention relates in a general way to heating devices employing catalytic combustion of gas, especially petroleum gases such as butane and propane, as well as to the appliances which incorporate such devices, especially heating appliances and domestic cooking appliances.

By way of domestic heating and cooking appliances may be mentioned for example ovens, deep-fat fryers, hotplates or griddles.

Devices for heating by catalytic combustion, such as radiating-surface catalytic burners, have been known for some time.

They are used for domestic purposes, such as auxiliary heating, or industrial purposes, such as drying.

As a general rule they involve atmospheric combustion at the surface of a catalytic support; the combustible gas is fed to the surface through the support, the catalytic combustion taking place in the open air as the combustible mixture emerges at the surface of the support.

The German document DE-A-1 401 162 describes a heating device using atmospheric catalytic combustion, comprising fibrous matter which is resistant to high temperatures, forming a coherent layered structure, this fibrous matter being impregnated with a substance having thermocatalytic activity.

Such a device includes means for creating a circulation of a combustible gas/combustive gas mixture through the said structure of fibrous matter impregnated with the catalytic substance in a direction substantially perpendicular to the plane of the said structure so that catalytic combustion occurs at the external surface thereof.

Furthermore, heating devices employing catalytic combustion are known in which the catalytic combustion of a combustible gas/combustive gas mixture occurs in a confined enclosure, from one end to the other of a circulation path devised inside a heating body.

The aforesaid German document DE-A-1 401 162 also describes a heating device employing catalytic combustion of gas of this type, which comprises a flat combustion enclosure delimited by two parallel plane walls. A catalytic lining taking the form of a layer of fibres impregnated with a catalytic substance is arranged inside the combustion enclosure parallel to the said plates. The lining delimits on one side a gas intake chamber and on the other side a burnt gas exhaust chamber. A gas circulation circuit is devised between an inlet for the gaseous mixture in the said gas intake chamber, and an outlet provided in the exhaust chamber.

The gas then circulates by passing through the layer-form catalytic structure in a direction perpendicular to the said structure, the heat liberated by the catalytic combustion being transmitted by convection and conduction to the plane walls defining the combustion enclosure and constituting heater plates.

Similarly, the document EP-0 380 705 describes a heating device using confined catalytic combustion which comprises, inside a heater body, a system for lighting a combustible gas/combustive gas mixture, which makes it possible to inject the said gas for combustion through a catalytic exchange surface. The catalytic exchange surface is arranged parallel to the external walls of the heater body some distance from them. Heating is effected by transmitting the heat of combustion liberated to one of the said walls constituting a heater plate.

The document U.S. Pat. No. 4,927,353 describes a heating device using catalytic combustion of great complexity, which furthermore includes, a catalytic combustion enclosure supplied with a gas mixture for combustion. This catalytic combustion enclosure takes the form of a hollow tube inside which is arranged a catalytic lining which defines on either side two combustion chambers, the gas passing through this lining producing the catalytic combustion which is transmitted via a gas outlet to heater plates.

The document U.S. Pat. No. 4,836,117 describes a heating system using catalytic combustion which takes the form of concentric cylinders inside which is devised a circulation of gas passing through a catalytic lining arranged in an interior bulb, the catalytic combustion enabling the exterior walls of the said system to be heated. In particular, this document concentrates on defining the material of the catalytic lining arranged inside the heating system.

All of these previously described heating devices involve the catalytic combustion of a combustible gas/combustive gas mixture in a catalytic support of porous or fibrous type, the catalyst usually being metallic.

Furthermore, they all exhibit the common characteristic whereby the catalytic support is situated some distance from the external heater walls or plates, so that there is necessarily a loss of efficiency in transmitting the heat originating from the catalytic combustion front situated some distance from the said heater plates.

Moreover, they all exhibit a complex layout and are of relatively large size by comparison with the heat liberated by the catalytic combustion.

Finally, the aforesaid devices cannot be altered or juxtaposed in order to be adapted to the relevant heating appliance.

Under these conditions, the present invention proposes a novel catalytic heating device exhibiting a novel arrangement of the catalytic support with respect to the path of the combustible gas/combustive gas mixture and to the external heater plate, which makes it possible to optimize the heating output of the device having regard to its size, through optimal transmission of heat to the heater plate constituting a transmission or radiation heating member.

The principle according to the invention is to lay out the device in such a way that the combustion front is located as close as possible to the surface to be heated.

More particularly, the heating device employing combustion of gas especially of petroleum gases according to the invention, comprises:

- a flat combustion enclosure delimited by two parallel large plane walls, at least one of which is a heater plate made of a metallic material, the said combustion enclosure being provided with at least one gas inlet and one outlet,
- a gas circulation circuit, devised inside the said combustion enclosure between each gas inlet and each outlet, the gas circulation passing through at least one catalytic contact surface.

It is characterized in that the gas circulation circuit is defined by at least one catalytic support partition, a longitudinal face of which constitutes the catalytic contact surface, the said partition extending perpendicularly to the heater plate, over practically the whole height of the said combustion enclosure so that the combustion front situated on the said catalytic support partition is flush with the heater plate, in the manner of an electric resistor element in an electric heating device with heater plates.

According to a characteristic of the heating device in accordance with the present invention, each catalytic support partition is drilled with a plurality of through holes, with axis perpendicular to the catalytic contact surface, so as to allow the gas for combustion to pass through each partition.

Each catalytic support partition may advantageously be made from ceramic.

Thus, as compared with the catalytic lining provided in the heating devices of the prior art, which are usually made in the form of a compaction of fibres, the device according to the invention exhibits a catalytic support in the form of a partition of the cellular type, having cells with specified and controlled geometry, this allowing greater output and greater control of the advance of the flame front.

Thus, in the prior art devices with catalytic lining in the form of a fibrous layer, it is impossible to control the advancing of the combustion front since the lining is unstable owing to the random distribution of the fibres in the layer constituting the lining and to their impregnation by the catalyst.

Problems with the transfer of matter due to the inhomogeneity of the fibrous layer and in some cases system runaway are observed in such devices.

According to particularly advantageous embodiment of the heating device according to the present invention, the flat combustion enclosure has a right-angled parallelepipedal shape. It comprises at least one pair of parallel catalytic support partitions, a gas exhaust chamber being defined between the two catalytic support partitions of each pair, and a gas intake chamber being defined on either side of each pair.

In this case, there is provided a gas inlet emerging into each intake chamber and a gas outlet in each exhaust chamber, the gas inlets communicating with each other via a common inlet duct provided in a first lateral upright delimiting the combustion enclosure. The gas outlets are either orifices formed in a heater plate or are outlets which emerge into a common outlet duct provided in a second lateral upright delimiting the combustion enclosure, parallel to the first lateral upright.

In a particularly advantageous manner, such a heating device may constitute an elementary module capable of being combined in parallel with several elementary modules by linking together the inlets and outlets respectively.

The description which follows, in conjunction with the appended drawings, given by way of non-limiting examples, will elucidate the makeup of the invention and the manner in which it may be embodied.

Figure 2:
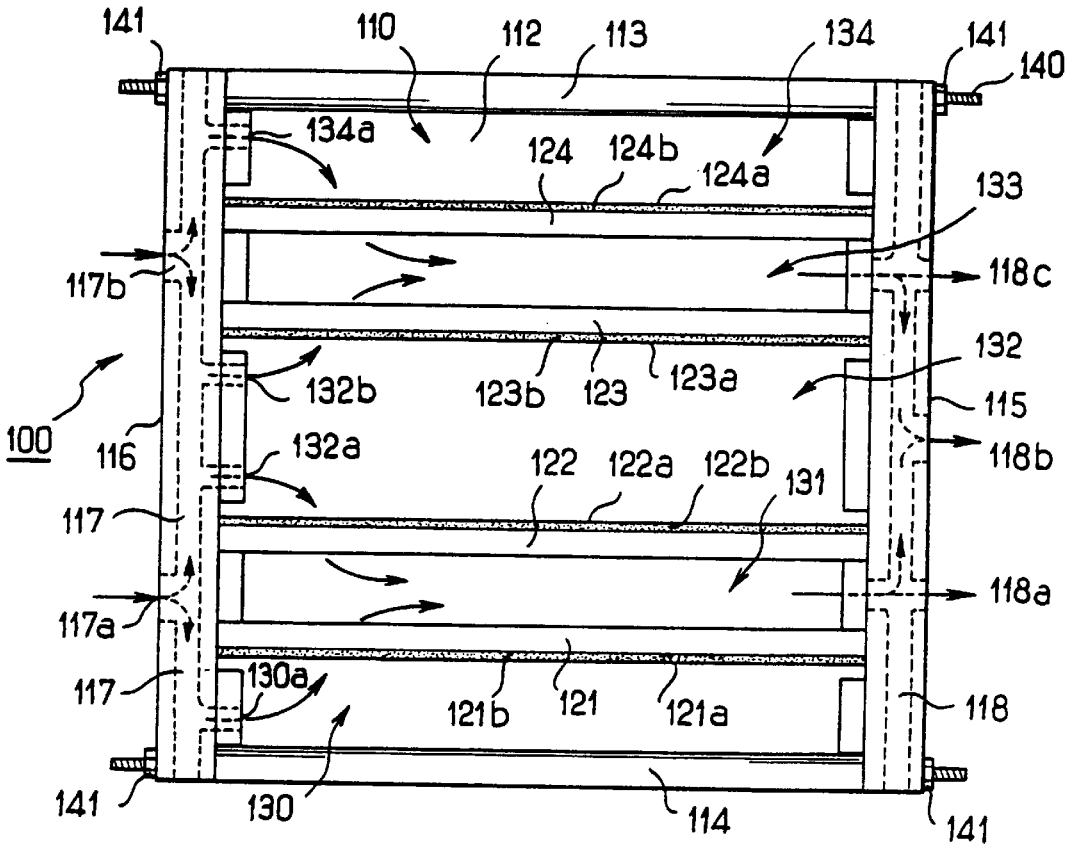
Figure 3:
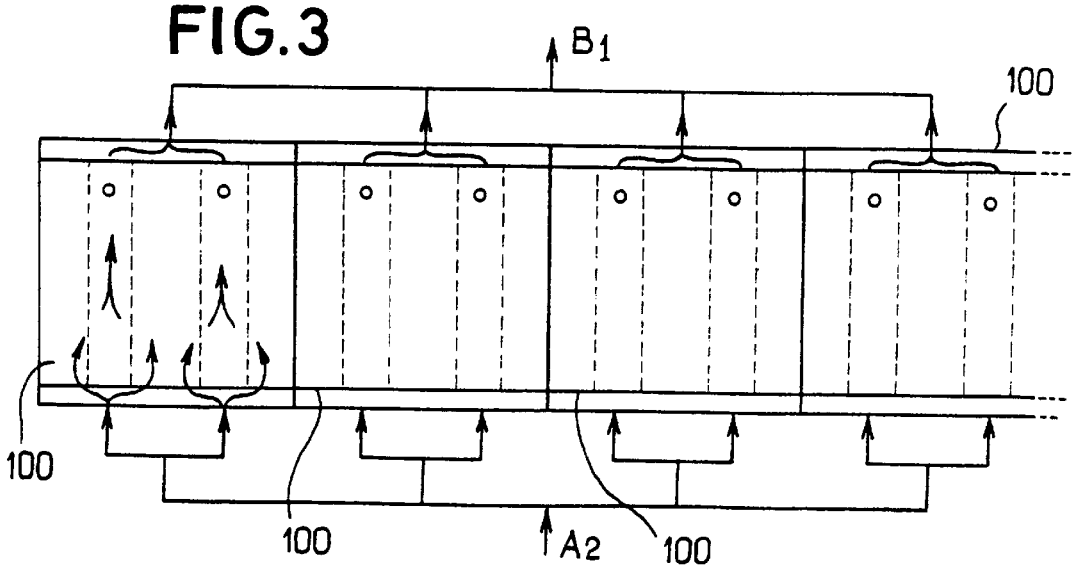

In the appended drawings:

FIG. 1 represents a schematic perspective view of a first embodiment of the heating device in accordance with the present invention, with partial cutaway of the heater plate, FIG. 2 represents a top view of a second embodiment of the heating device in accordance with the present invention without its heater plate, FIG. 3 represents schematically, in a top view, the combining in parallel of several elementary modules in accordance with the present invention.

Represented in FIGS. 1 and 2 is a heating device employing catalytic combustion of gas 100, especially of petroleum gas, such as propane or butane. This heating device 100 includes a combustion enclosure 110 delimited between two parallel large plane walls 111, 112 and four lateral uprights 113, 114, 115 and 116.

This catalytic combustion enclosure 110 has, in this example, a right-angled parallelepipedal shape.

In the example represented, one of the large plane walls 112 defines the bottom of the combustion enclosure and has curved lateral edges forming two of the four lateral uprights 113, 114 delimiting the said enclosure. The other parallel large plane wall 111 is fitted in a removable manner so as to close the combustion enclosure 110 from above (see more particularly FIG. 1). This large plane wall 111 fitted in a removable manner is made from a metallic material, such as stainless or non-stainless steel for example, and constitutes the heater plate of the heating device. Of course, according to a variant embodiment of this device, it is possible to envisage the plane wall constituting the bottom of the combustion enclosure as also being a heater plate, then made from metal, of the said device. It can also be made from a heat-resistant and thermally insulating material so as not to act as a heater plate. It is of interest to point out that the thermal seal on the side of the heater plate 111 of the heating device 100 is made at the level of the closure of the said heater plate 111.

The large plane wall 112 forming the bottom of the combustion enclosure 110, as well as the other two parallel lateral uprights 115, 116, are held firmly together by way of two parallel threaded rods 140 introduced through the lateral uprights 115, 116 at each of their extremities and screwed onto the outsides thereof using nuts 141 to secure the said parallel lateral uprights 115, 116 against the edges of the large plane wall 112 with curved edges and to clamp it between the said lateral uprights 115, 116. Of course, any other mechanical system of assembly may be used (clips, welding, adhesive bonding etc.).

Naturally, provision may be made, according to a variant not represented, for the large plane wall 112 forming the bottom of the combustion enclosure to be fitted in a removable manner to the lateral uprights.

Furthermore, the heating device employing catalytic combustion of gas 100 includes, inside the said combustion enclosure 110, a gas circulation circuit devised between at least one gas inlet and one outlet provided in the combustion enclosure. This gas circulation circuit is defined by catalytic support partitions 121, 122, 123, 124, each catalytic support partition having a longitudinal face which constitutes a catalytic contact surface through which the said gas circulation circuit passes.

More particularly, in the example represented in FIGS. 1 and 2, there are provided two pairs of parallel catalytic support partitions 121, 122, and 123, 124, a gas intake chamber 130, 132, 134 being defined on either side of each pair of catalytic partitions 121, 122, 123, 124, and a gas exhaust chamber 131, 133 being defined between the two catalytic support partitions 121, 122 and 123, 124 of each pair.

Each catalytic support partition extends perpendicularly to the two large plane walls 111, 112 over practically the whole of the height of the catalytic combustion enclosure 110 and, lengthwise, over the whole of the length of the catalytic combustion enclosure.

That external longitudinal face of each catalytic support partition 121, 122, 123, 124 which overlooks the gas intake chambers 130, 132, 134 is coated with a catalytic deposition based on platinum or on platinum-palladium or any other complex mixture having catalytic properties so as to constitute the catalytic contact surface through which the gas mixture for combustion passes.

Thus, the external longitudinal face of each catalytic support partition defines a catalytic contact surface 121*a*, 122*a*, 123*a*, 124*a*.

The arrangement of the catalytic support partitions 121, 122, 123, 124 perpendicular to the large plane walls and in particular to the heater plate 111 while extending over practically the whole of the height of the said combustion enclosure means that the combustion fronts 121*b*, 122*b*, 123*b*, 124*b* situated on the said catalytic support partitions 121, 122, 123, 124, on the side of the external longitudinal face constituting the catalytic contact surface 121*a*, 122*a*, 123*a*, 124*a*, are flush with the heater plate 111, in the manner of an electric resistor element in an electric heating device with heater plate.

It will be observed more particularly in FIG. 1 that each catalytic support partition 121, 122, 123, 124 is drilled with a plurality of through holes, with axis perpendicular to the catalytic contact surface 121*a*, 122*a*, 123*a*, 124*a*, so as to allow the gas for combustion to pass through each partition 121, 121, 123, 124. The through holes are regularly distributed and calibrated cells. Each catalytic support partition 121, 122, 123, 124 is made from ceramic, for example based on cordierite. Provision may be made to produce each catalytic support partition from any other material such as ceramicized metallic fibre in the form of felt or knitwork.

In the embodiment represented in FIGS. 1 and 2, there are provided gas inlets 130*a*, 132*a*, 132*b*, 134*a*, emerging into the intake chambers 130, 132, 134, and a gas outlet 111*a*, 111*b*, 118*a*, 118*c*, in each exhaust chamber 131, 133. The gas inlets communicate with each other via a common inlet duct 117 provided in a first lateral upright 116 delimiting the combustion enclosure 110.

There may advantageously be provided at least one inlet manifold (not represented here) which injects a combustible gas/combustive gas mixture of gases into the inlet duct 117 via external inlets 117*a*, 117*b*. This inlet manifold advantageously exhibits an excess pressure of between 0 and a few tens of millibars relative to atmospheric pressure, so that the circulation of the catalytically combusting mixture takes place inside the combustion enclosure from one end of the circuit to the other, ensuring complete combustion therein.

The combustible gas/combustive gas mixture at the inlet 117*a*, 117*b* of the circuit of the heating device 100 is substantially stoichiometric, whereas the mixture at the outlet of the circuit contains no unburnt residues, but essentially $CO_2$.

In the embodiment represented in FIG. 1, the gas outlets are orifices 111*a*, 111*b*, formed in the large plane wall forming the heater plate 111 and also constituting the cover of the combustion enclosure.

In a variant embodiment represented in FIG. 2, the gas outlets 118*a*, 118*c* are formed in a second lateral upright 115 parallel to the first lateral upright 116 and emerge into a common outlet duct 118 provided in the said lateral upright 115. This common outlet duct 118 includes a central outlet 118*b* situated in the middle of the upright.

Furthermore, as may be observed, the outlets 118*a* and 118*c* formed in the lateral upright 115 emerge to the outside directly from the combustion enclosure 110.

The embodiment of FIG. 1 is particularly adapted to constitute a catalytic combustion heating device of a heating appliance of the oven type, since the fumes from the catalytic combustion escape through the orifices 111*a*, 111*b* formed in the heater plate 111, directly inside the oven so as to improve the cooking of foods in the oven.

By contrast, the embodiment represented in FIG. 2 is more particularly adapted for appliances of the deep-fat fryer, griddle or hotplate type or heating appliances of any kind.

In the embodiment represented in FIG. 2, an outlet manifold (not represented here) may be provided located on the gas outlets 118*a*, 118*b*, 118*c*, this outlet manifold being capable of collecting the combustion fumes exhausted from the said combustion enclosure.

The catalytic combustion heating device represented in FIGS. 1 and 2 can constitute an elementary module capable of being combined in parallel with several elementary modules of the same type according to geometrical patterns and powers which are adapted to the geometry of the appliance envisaged by linking together the inlet ducts, as shown schematically in FIG. 3.

More particularly, it will be observed in FIGS. 1 and 2 that the common inlet ducts 117 include lateral apertures provided with an internal thread (see FIG. 1) which are capable of being shut off by means of screws when the heating device is used alone or of being linked to other inlet ducts of heating devices of the same type for fitting in parallel as shown schematically in FIG. 3.

Thus, FIG. 3 shows a combination of four elementary modules of the type of the heating device 100 represented in FIG. 2. It may be seen here that the common inlet ducts are linked together and a manifold shown schematically as $A_1$ dispenses a gaseous mixture into the said ducts. The common outlet ducts are linked together in the same way as the inlet ducts and emerge into a common outlet manifold shown schematically as $B_1$. The heater surface of the heating device can easily be adapted as a function of the heating appliance envisaged.

It is of interest to point out that a heating device of the type represented in FIGS. 1 or 2 is of a minimum size, for example the combustion enclosure has dimensions of 15 cm by 15 cm along the sides, for a maximum power, in the example given the power delivered is of the order of 1 kWatt.

Moreover, the catalytic combustion heating module or device represented in FIGS. 1 to 3 can particularly advantageously include ignition means (not represented) for the combustion in the vicinity of the gas inlet of the combustion enclosure.

The ignition means (not represented) can consist of any device generating sufficient heat, such as a piezoelectric device which generates an electrical spark, an electrical discharge, an electrical resistance capable of producing local heat.

Finally, such a device 100 can include at the outlet of the gas circuit a suction device (not represented) capable of sucking up the fumes generated by the catalytic combustion, so as to ensure upstream the circulation of the catalytically combusting mixture from one end of the circuit to the other.

The present invention is in no way limited to the embodiments described and represented, but those skilled in the art will be able to contrive any variant in accordance with the spirit thereof.

I claim:

1. Heating device (100) employing catalytic combustion of gas, especially of petroleum gases, comprising:

a flat combustion enclosure (110) delimited by two parallel large plane walls (111, 112), at least one of which is a heater plate made of a metallic material, the said combustion enclosure (110) being provided with at least one gas inlet (130*a*, 132*a*, 132*b*, 134*a*) and one outlet (111*a*, 111*b*), a gas circulation circuit, devised inside the said combustion enclosure (110) between each gas inlet (130*a*, 132*a*, 132*b*, 134*a*) and each outlet, the gas circulation circuit passing through at least one catalytic contact surface (121*a*, 122*a*, 123*a*, 124*a*), characterized in that the gas circulation circuit is defined by at least one catalytic support partition (121, 122, 123, 124), a longitudinal face of which constitutes the catalytic contact surface (121*a*, 122*a*, 123*a*, 124*a*), the said partition extending perpendicularly to the heater plate (111), over practically the whole height of the said combustion enclosure (110) so that the combustion front (121*b*, 122*b*, 123*b*, 124*b*) situated on the said catalytic support partition (121, 122, 123, 124) is flush with the heater plate (111), in the manner of an electric resistor element in an electric heating device with heater plate.

2. Heating device according to claim 1, characterized in that each catalytic support partition (121, 122, 123, 124) is drilled with a plurality of through holes, with axis perpendicular to the catalytic contact surface (121*a*, 122*a*, 123*a*, 124*a*), so as to allow the gas for combustion to pass through each partition.

3. Heating device according to claim 2, characterized in that each catalytic support partition (121, 122, 123, 124) is made from ceramic.

4. Heating device according to claim 1, characterized in that the longitudinal face of each catalytic support partition (121, 122, 123, 124), which defines the catalytic contact surface (121*a*, 122*a*, 123*a*, 124*a*), is coated with a catalytic deposition based on platinum or platinum-palladium.

5. Heating device according to claim 1, characterized in that the two parallel large plane walls (111, 112) delimiting the flat combustion enclosure (110) constitute two heater plates made of metallic material.

6. Heating device according to claim 1, characterized in that each heater plate (111) is fitted in a removable manner.

7. Heating device according to claim 1, characterized in that the flat combustion enclosure (110) has a right-angled parallelepipedal shape.

8. Heating device according to claim 1, characterized in that it comprises at least one pair of parallel catalytic support partitions (121, 122, 123, 124), a gas exhaust chamber (131, 133) being defined between the two catalytic support partitions (121, 122, 123, 124) of each pair, and a gas intake chamber (130, 132, 134) being defined on either side of each pair.

9. Heating device according to claim 8, characterized in that there is provided at least one gas inlet (130*a*, 132*a*, 132*b*, 134*a*) emerging into each intake chamber (130, 132, 134) and at least one gas outlet (111*a*, 111*b*) in each exhaust chamber (131, 133), the gas inlets (130*a*, 132*a*, 132*b*, 134*a*) communicating with each other via a common inlet duct (117) provided in a first lateral upright (116) delimiting the combustion enclosure (110).

10. Heating device according to claim 9, characterized in that it includes at least one inlet manifold which injects a gaseous mixture into the inlet duct.

11. Heating device according to claim 10, characterized in that the inlet manifold exhibits an excess pressure of between 0 and a few tens of millibars relative to atmospheric pressure, so that the circulation of the catalytically combusting mixture takes place from one end of the circuit to the other, ensuring complete combustion therein.

12. Heating device according to claim 9, characterized in that the gas outlets (11*a*, 111*b*) are orifices formed in a heater plate (111).

13. Heating device according to claim 9, characterized in that the gas outlets (118*a*, 118*c*) emerge into a common outlet duct (118) provided in a second lateral upright (115) delimiting the combustion enclosure (110), parallel to the first lateral upright (116).

14. Heating device according to claim 13, characterized in that it includes an outlet manifold which collects the combustion fumes exhausted from the said combustion duct.

15. Heating device according to claim 1, characterized in that it constitutes an elementary module (100) capable of being combined in parallel with several elementary modules (100) by linking together the inlets and outlets respectively.

16. Heating device according to claim 1, characterized in that it includes ignition means for the combustion in the vicinity of the gas inlet of the combustion enclosure.

17. Heating device according to claim 1, characterized in that the combustible gas/combustive gas mixture at the inlet of the circuit is substantially stoichiometric, whereas the mixture at the outlet of the circuit contains no unburnt residues, but essentially $CO_2$.

18. Heating device according to claim 16, characterized in that the ignition means consist of any device generating sufficient heat, such as a piezoelectric device which generates an electrical spark, an electrical discharge, an electrical resistance, capable of producing local heat.

19. Heating device according to claim 1, characterized in that it includes at the outlet of the circuit a suction device capable of sucking up the fumes generated by the catalytic combustion, so as to ensure upstream the circulation of the catalytically combusting mixture from one end of the circuit to the other.

20. Domestic cooking appliance, characterized in that it comprises a heating device according to claim 1.

* * * * *